US005738069A

United States Patent [19]

St. Pierre et al.

[11] Patent Number: 5,738,069

[45] Date of Patent: Apr. 14, 1998

[54] ADJUSTABLE SPEED CONTROL SYSTEM FOR A MOTOR VEHICLE

[76] Inventors: Romeo David St. Pierre, P.O. Box 115, Carmel, Me. 04419; Michael E. Lawrence, 4703 Coventry Pkwy., Ft. Wayne, Ind. 46804; Kevin C. Gatti, P.O. Box 975, Avon, Conn. 06001; Richard B. Rodgerson, 243 North Rd., Winterport, Me. 04496

[21] Appl. No.: 738,298

[22] Filed: Oct. 25, 1996

[51] Int. Cl.[6] ..... F02D 11/04

[52] U.S. Cl. ..... 123/342; 123/400

[58] Field of Search ..... 123/342, 400; 180/178, 197; 74/513

[56] References Cited

U.S. PATENT DOCUMENTS

| | | | |
|---|---|---|---|
| 5,152,360 | 10/1992 | Haefner et al. | 123/342 X |
| 5,163,401 | 11/1992 | Reese | 123/376 |
| 5,191,866 | 3/1993 | Tosdale | 123/400 |
| 5,339,783 | 8/1994 | Teichert | 123/400 |
| 5,467,663 | 11/1995 | Trowbridge | 74/481 |

FOREIGN PATENT DOCUMENTS

| | | | |
|---|---|---|---|
| 2809894 | 9/1979 | Germany | 123/342 |

*Primary Examiner*—Tony M. Argenbright
*Attorney, Agent, or Firm*—McCormick, Paulding & Huber

[57] ABSTRACT

An adjustable speed control system (10) for a motor vehicle (12) comprising a first flexible cable (14) having a first end (16) connected to a throttle lever (18) on a carburetor (20) in an internal combustion engine (22) of the motor vehicle (12). A second flexible cable (24) has a first end connected to a throttle control handle on the motor vehicle (12). A structure (26) mounted within the motor vehicle (12) is for coupling a second end (28) of the first flexible cable (14) to a second end (30) of the second flexible cable (24). A facility (32) mounted within the motor vehicle (12) is for controlling movement of the second ends (28), (30) of the first flexible cable (14) and the second flexible cable (24) within the coupling structure (26), thereby limiting operation of the throttle lever (18) on the carburetor (20).

16 Claims, 3 Drawing Sheets

ADJUSTABLE SPEED CONTROL SYSTEM FOR A MOTOR VEHICLE

BACKGROUND OF THE INVENTION

1. Field of the Invention

The instant invention relates generally to throttle control devices and more specifically it relates to an adjustable speed control system for a motor vehicle.

2. Description of the Prior Art

Numerous throttle control devices have been provided in prior art. For example, U.S. Pat. Nos. 5,163,401 to Reese; 5,191,866 to Tosdale; 5,339,783 to Teichert and 5,467,663 to Trowbridge all are illustrative of such prior art. While these units may be suitable for the particular purpose to which they address, they would not be as suitable for the purposes of the present invention as heretofore described.

U.S. Pat. No. 5,163,401 discloses an override speed control mechanism for an internal combustion engine. The override speed control system comprises a speed control lever that is movable by an operator within an actuation range having a lower control limit and an upper control limit. A throttle control Mechanism is connectable to the carburetor to actuate the throttle plate of the carburetor. A coupling lever is detachably coupled to the speed control lever and the throttle control mechanism. The throttle control mechanism is caused to move through its entire operating range in response to movement of the speed control lever through a predetermined partial portion of its actuation range. The effective range of the speed control lever corresponds to the operating range of the throttle control mechanism, and movement of the speed control lever between the lower override limit and the lower control limit, and between the upper override limit and the upper control limit is ineffective to further move and throttle control mechanism.

U.S. Pat. No. 5,191,866 discloses a throttle control system for an automotive vehicle includes a motion transmitting member having a length sufficient to extend between an accelerator pedal and a throttle crank, so that depression of the accelerator will cause rotation of a throttle shaft attached to the crank. The motion transmitting member includes a provision allowing it to deflect, so as to permit further movement of the accelerator pedal without further rotation of the throttle shaft once the throttle shaft has been moved to the wide open throttle position.

U.S. Pat. No. 5,339,783 discloses a throttle breakover apparatus having a cable with one end coupled to an accelerator pedal and a second end terminating in a cable stop. The cable second end is slideably coupled to an engine throttle lever at a position inward from the cable stop. A sleeve surrounds the cable and extends from the cable stop through the throttle lever. A coil spring surrounds the sleeve and is positioned between the throttle lever and the cable stop. A spring guide guides the motion of the coil spring. In response to the depression of the accelerator pedal, the throttle cable first pivots the throttle lever to a full throttle position. Once full throttle is reached, the coil spring is compressed between the cable stop and the throttle lever and absorbs the additional "breakover" movement of the cable.

As seen in U.S. Pat. No. 5,467,663, cable assemblies are useful for controlling the engine governor of a vehicle. On some vehicles the operator must control the governor from two different locations or operating positions of the operator. The subject arrangement includes a cable assembly having a first end portion connected to a vehicle governor, a second end portion and an intermediate portion. A lever is connected to the second end portion to control the vehicle governor. A pedal is connected to the intermediate portion to also control the vehicle governor. This arrangement of components provides a single cable assembly, which can be actuated from two locations for controlling the vehicle governor.

SUMMARY OF THE INVENTION

A primary object of the present invention is to provide an adjustable speed control system for a motor vehicle that will overcome the shortcomings of the prior art devices.

Another object is to provide an adjustable speed control system for a motor vehicle that is key operable, in which a throttle speed can be preset and controlled to increase safety performance, so as to satisfy the publics concern for safety.

An additional object is to provide an adjustable speed control system for a motor vehicle that will aid law enforcement personal in the control and prevention of serious accidents, and driving while intoxicated related incidents.

A still additional object is to provide an adjustable speed control system for a motor vehicle that will increase safety handling for a novice or inexperienced driver, and to maintain parental control of the motor vehicle by presetting the speed, thus reducing the likelihood of an accident.

A further object is to provide an adjustable speed control system for a motor vehicle that is simple and easy to use.

A still further object is to provide an adjustable speed control system for a motor vehicle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
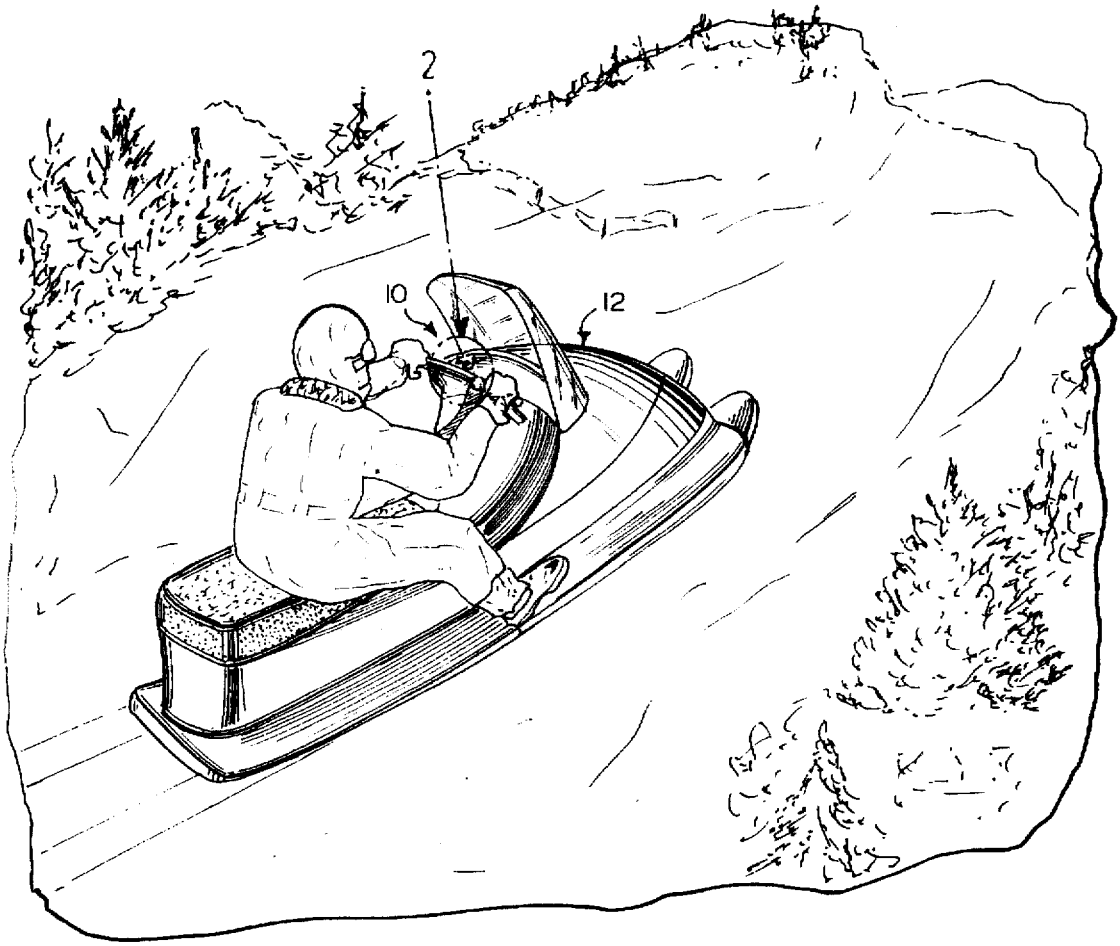
FIG. 1 is a rear perspective view of a motor vehicle being a snowmobile with the instant invention installed and in use.

Turning now descriptively to the drawings, in which similar reference characters denote similar elements throughout the several views, FIGS. 1 to 9 illustrate an adjustable speed control system 10 for a motor vehicle 12, comprising a first flexible cable 14 having a first end 16 connected to a throttle lever 18 on a carburetor 20 in an internal combustion engine 22 of the motor vehicle 12. A second flexible cable 24 has a first end connected to a throttle control handle (not shown) on the motor vehicle 12. A structure 26 mounted within the motor vehicle 12 is for coupling a second end 28 of the first flexible cable 14 to a second end 30 of the second flexible cable 24. A facility 32 mounted within the motor vehicle 12 is for controlling movement of the second end 28, 30 of the first flexible cable 14 and the second flexible cable 24 within the coupling structure 26, thereby limiting operation of the throttle lever 18 on the carburetor 20.

Figure 9:
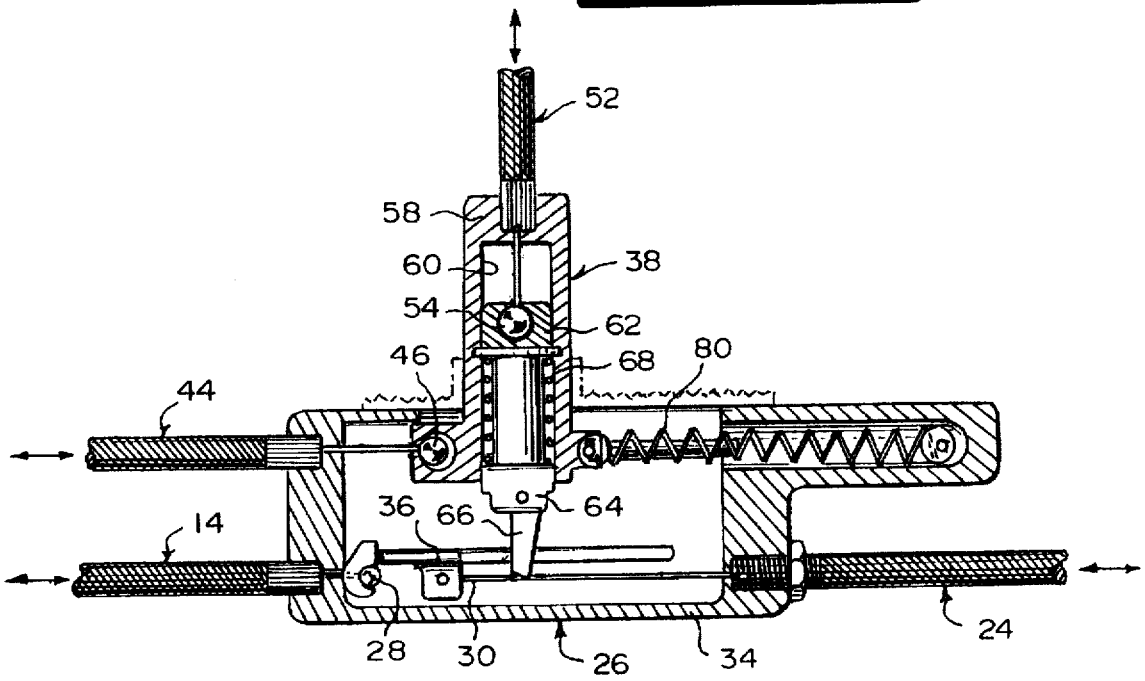
FIG. 9 is a cross sectional view of the lower block unit taken from the opposite direction, as shown in FIG. 3.

The coupling structure 26, as best seen in FIG. 9, includes a casing 34. A cable connector 36 is carried with the casing 34, to retain together the second ends 28, 30 of the first flexible cable 14 and the second flexible cable 24.

The movement controlling facility 32 consists of a speed control assembly 38 extending into the casing 34, to engage with the cable connector 36 and limit movement of the cable connector 36 within the casing 34. A housing 40 is provided. A speed adjustment assembly 42 is carried within the housing 40. A third flexible cable 44 has a first end 46 connected to the speed control assembly 38 within the casing 34 and a second end 48 connected to the speed adjustment assembly 42. A speed engagement assembly 50 is carried within the housing 40. A fourth flexible cable 52 has a first end 54 connected to the speed control assembly 38 extending from the casing 34 and a second end 56 connected to the speed engagement assembly 50.

The speed control assembly 38 comprises an enclosure 58 having a passageway 60, which extends perpendicular into the casing 34. An engagement shaft 62 is mounted in a sliding manner within the passageway 60 of the enclosure 58 and is connected at a top end to the first end 54 of the fourth flexible cable 52. An engagement cap 64 is affixed to a bottom end of the engagement shaft 62. An engagement lever 66 is pivotally affixed to the cap 64. A compression spring 68 is on the engagement shaft 62 to bias the engagement shaft 62, so that the engagement lever 66 will normally extend perpendicular into the path of the cable connector 36.

The speed adjustment assembly 42 includes a speed adjustment screw 70, having a threaded shaft 72 and an enlarged head 74 carried within the housing 40, so that the enlarged head 74 extends through the housing 40. A locking nut 76 is affixed onto an inner end of the threaded shaft 72 of the speed adjustment screw 70. An adjustable cable retainer 78 on the threaded shaft 72 of the speed adjustment screw 70, connects to the second end 48 of the third flexible cable 44. An extension spring 80 is connected longitudinally between one side of the enclosure 58 of the speed control assembly 38 within the casing 34 and attached to the casing 34. The first end 46 of the third flexible cable 44 is connected longitudinally to an opposite side of the enclosure 58 of the speed control assembly 38 within the casing 34, so that the engagement lever 66 can be adjusted longitudinally with respect to the cable connector 36.

The speed engagement assembly 50 consists of an engagement cam 82 rotatably carried within the housing 40, to contact the speed adjustment screw 76. A fixed cable retainer 84 is on the engagement cam 82, which connects to the second end 56 of the fourth flexible cable 52. An engagement cam driver 86 is connected to the engagement cam 82. A cam lock cylinder 88 is connected to the engagement cam driver 86. A key 90 is insertable into the cam lock cylinder 88, to operate the cam lock cylinder 88.

Figure 4:
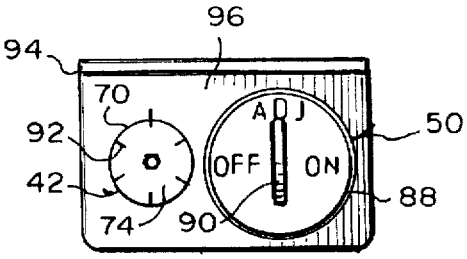
FIG. 4 is a front view of the upper block unit taken in the direction of arrow 4 in FIG. 3.
Figure 5:
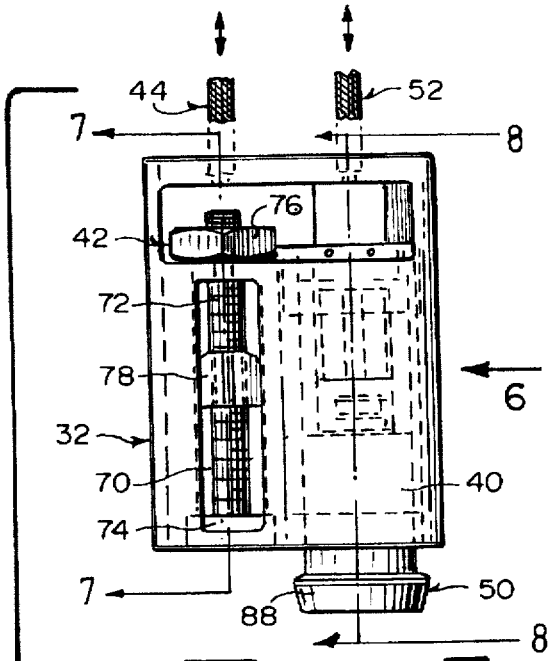
FIG. 5 is a top view of the upper block unit taken in the direction of arrow 5 in FIG. 3.
Figure 6:
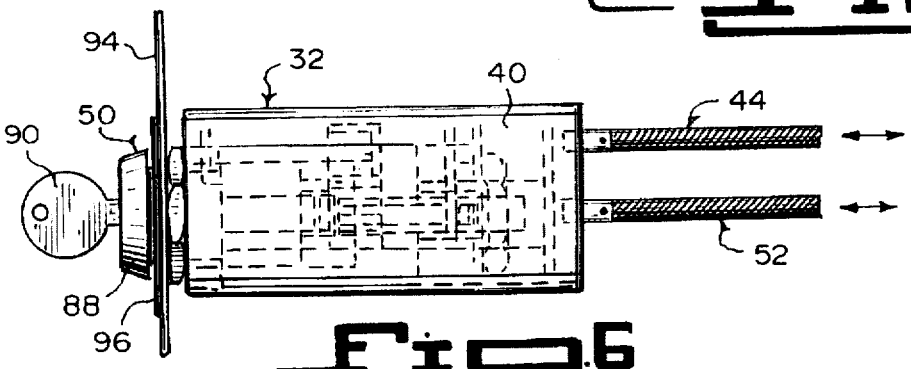
FIG. 6 is a side view of the upper block unit taken in the direction of arrow 6 in FIG. 5.
Figure 7:
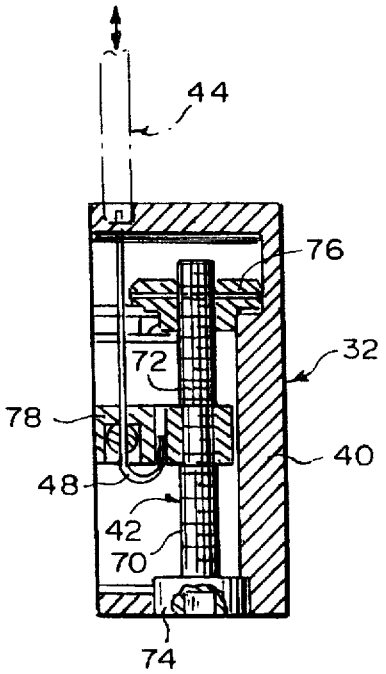
FIG. 7 is a cross sectional view taken along line 7—7 in FIG. 5, showing the speed adjustment assembly in greater detail.
Figure 8:
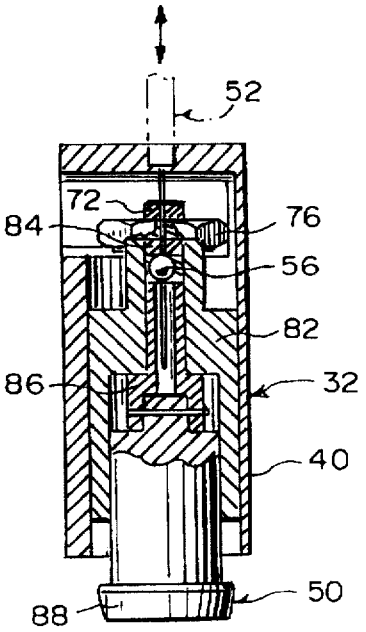
FIG. 8 is a cross sectional view taken along line 8—8 in FIG. 5, showing the speed engagement assembly in grater detail.

As shown in FIG. 4, the enlarged head 74 of the speed adjustment screw 70 contains alignment markings 92, to indicate the setting of the speed adjustment screw 70. The cam lock cylinder 88 includes three positions operable by the key 90, which are off, adjustment and on. When the key 90 is turned to the off position, the engagement lever 66 will move away from the path of the cable connector 36. When the key 90 is turned to the adjust position, the speed adjustment screw 70 can be turned to adjust the engagement lever 66 with respect to the cable connector 36. When the key is turned to the on position and then removed from the cam lock cylinder 88, the engagement lever 66 will be maintained in place with respect to the cable connector 36.

The adjustable speed control system 10 further includes a cowling 94, to secure the housing 40 with the speed adjustment assembly 42 and the speed engagement assembly 50 to the motor vehicle 12. An indicia plate 96 is mounted to the cowling 94. Upon the indicia plate 94 are the alignment markings 92, to indicate the setting of the speed adjustment screw 70 and three positions of the key 90 in the cam lock cylinder 88.

OPERATION OF THE INVENTION

When the adjustable speed control system 10 is properly installed in the motor vehicle 12, the following operation applies:

Initial Adjustment:

To adjust the speed of the internal combustion engine 12 to a desired level, the key 90 must be inserted into the cam lock cylinder 88 and set to the adjustment position marked on the indicia plate 96. At this point the engagement cam 82 will not interfere with the ability of the locking nut 76 to rotate. The speed adjustment screw 70 can now be adjusted by being turned clockwise or counter-clockwise, until a desired speed is obtained.

This can be accomplished with or without the internal combustion engine 12 running. With the speed adjustment screw 70 set to the desired level, the key 90 can be engaged in the on position or disengaged in the off position located on the indicia plate 96. The key 90 needs to be removed to lock the locking nut 76 at the previous settings(s).

Normal Usage:

Generally speaking, once the speed has been set, then the key 90 will be used to engage or disengage the engagement lever 66. When the key 90 is in the off position, then the engagement cam driver 86 and the cam lock cylinder 88 will lock the engagement cam 82 against the locking nut 76, therefore pulling the engagement lever 66 of the speed control assembly 38 out of the way of the cable connector 36, for an unrestricted use of the throttle lever 18.

When the key 90 is in the on position, then the engagement cam driver 86 and the cam lock cylinder 88 will lock the engagement cam 82 against the locking nut 76, therefore releasing the engagement lever 66 of the speed control assembly 38 from the clearance position to the interference position of the cable connector 36, thereby restricting the throttle lever 18 to the previously adjusted speed.

Figure 2:
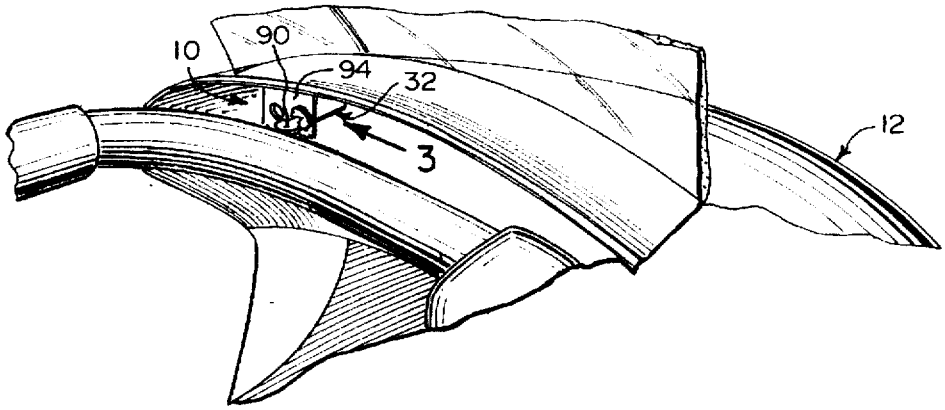
FIG. 2 is an enlarged rear perspective view of an area with the instant invention as indicated by arrow 2 in FIG. 1.
Figure 3:
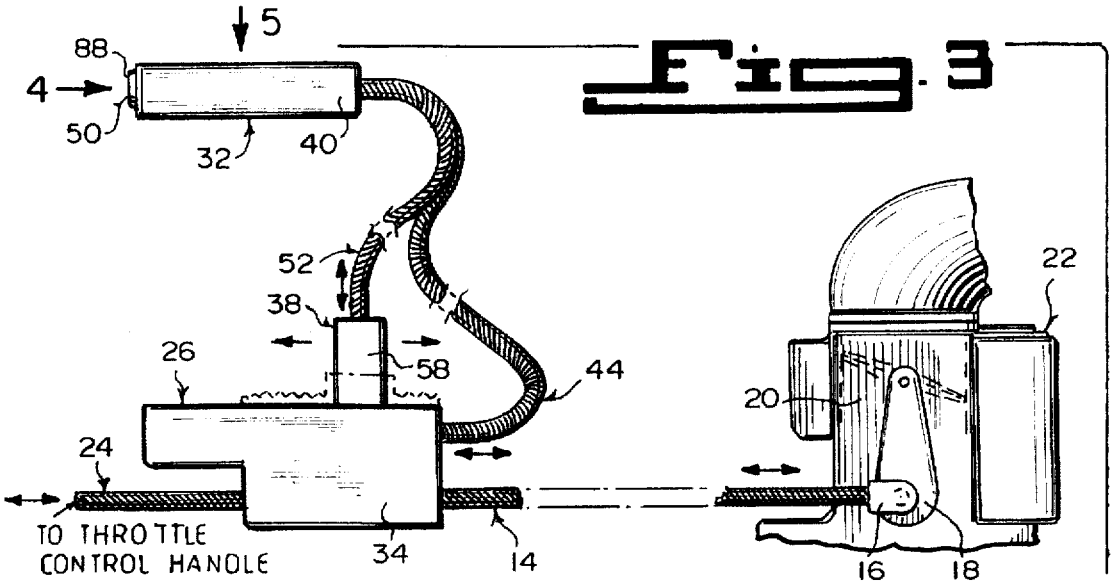
FIG. 3 is a side view with parts broken away taken in the direction of arrow 3 in FIG. 2.

The adjustable speed control system 10 can be used in any type of motor vehicle 12, such as an automobile, bus, truck, boat, motorcycle, snowmobile, which is shown in FIGS. 1 and 2, and other motor driven vehicles. The instant invention can also be used on industrial motors, to control RPMs to a safe running range. The location of the installation of the adjustable speed control system 10 can be in any convenient area on the different motor vehicles 12. In the future, the instant invention can also be made in an electronic type mode.

LIST OF REFERENCE NUMBERS

10 adjustable speed control system
12 motor vehicle
14 first flexible cable of 10
16 first end of 14
18 throttle lever on 20
20 carburetor in 22
22 internal combustion engine of 12
24 second flexible cable of 10
26 coupling structure of 10
28 second end of 14
30 second end of 24
32 movement controlling facility of 10
34 casing of 26
36 cable connector of 26
38 speed control assembly of 32 in 34
40 housing of 32
42 speed adjustment assembly of 32 in 40
44 third flexible cable of 32
46 first end of 44
48 second end of 44
50 speed engagement assembly of 32 in 40
52 fourth flexible cable of 32
54 first end of 52
56 second end of 52
58 enclosure of 38
60 passageway in 58
62 engagement shaft of 38
64 engagement cap of 38
66 engagement lever of 38 on 64
68 compression spring of 38 on 62
70 speed adjustment screw of 42
72 threaded shaft of 70
74 enlarged head of 70
76 locking nut of 42
78 adjustable cable retainer of 42
80 extension spring of 42
82 engagement cam of 50
84 fixed cable retainer of 50
86 engagement cam driver of 50
88 cam lock cylinder of 50
90 key of 50
92 alignment markings on 74
94 cowling of 10
96 indicia plate It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An adjustable speed control system for a motor vehicle comprising:

a) a first flexible cable having a first end connected to a throttle lever on a carburetor in an internal combustion engine of the motor vehicle;

b) a second flexible cable having a first end connected to a throttle control handle of the motor vehicle;

c) a casing mounted within the motor vehicle;

d) a cable connector carried within said casing to retain together the second ends of said first and second flexible cables;

e) a speed control assembly extending into said casing to engage with and limit the movement of said cable connector within said casing;

f) a housing having a speed adjustment assembly, and a speed engagement assembly carried therein; and g) a third flexible cable having a first end connected to said speed control assembly within said casing and a second end connected to said speed adjustment assembly, and a fourth flexible cable having a first end connected to said speed control assembly and a second end connected to said speed engagement assembly.

2. An adjustable speed control system for a motor vehicle as recited in claim 1, wherein said speed control assembly includes:

a) an enclosure having a passageway which extends perpendicular into said casing;

b) an engagement shaft mounted in a sliding manner within said passageway of said enclosure and connected at a top end to the first end of said fourth flexible cable;

c) an engagement cap affixed to a bottom end of said engagement shaft;

d) an engagement lever pivotally affixed to said cap; and e) a compression spring on said engagement shaft to bias said engagement shaft, so that said engagement lever will normally extend perpendicular into the path of said cable connector.

3. An adjustable speed control system for a motor vehicle as recited in claim 2, wherein said speed adjustment assembly includes:

a) a speed adjustment screw having a threaded shaft and an enlarged head carried within said housing, so that said enlarged head extends through said housing;

b) a locking nut affixed onto an inner end of said threaded shaft of said speed adjustment screw; and c) an adjustable cable retainer on said threaded shaft of said speed adjustment screw which connects to the second end of said third flexible cable; and d) an extension spring connected longitudinally between one side of said enclosure of said speed control assembly within said casing and attached to said casing with the first end of said third flexible cable connected longitudinally to an opposite side of said enclosure of said speed control assembly within said casing, so that said engagement lever can be adjusted longitudinally with respect to said cable connector.

4. An adjustable speed control system for a motor vehicle as recited in claim 3, wherein said speed engagement assembly includes:

a) an engagement cam rotatably carried within said housing, to contact said speed adjustment screw;

b) a fixed cable retainer on said engagement cam which connects to the second end of said fourth flexible cable;

c) an engagement cam driver connected to said engagement cam;

d) a cam lock cylinder connected to said engagement cam driver; and e) a key insertable into said cam lock cylinder to operate said cam lock cylinder.

5. An adjustable speed control system for a motor vehicle as recited in claim 3, wherein said enlarged head of said speed adjustment screw includes alignment markings to indicate the setting of said speed adjustment screw.

6. An adjustable speed control system for a motor vehicle as recited in claim 4, wherein said cam lock cylinder includes three positions operable by said key, which are off, adjustment and on, whereby when said key is turned to the off position, said engagement lever will move away from the path of said cable connector, when said key is turned to the adjust position said speed adjustment screw can be turned to adjust said engagement lever with respect to said cable connector, and when said key is turned to the on position and then removed from said cam lock cylinder, said engagement lever will be maintained in place with respect to said cable connector.

7. An adjustable speed control system for a motor vehicle as recited in claim 3, further including a cowling to secure said housing with said speed adjustment assembly and said speed engagement assembly to the motor vehicle.

8. An adjustable speed control system for a motor vehicle as recited in claim 7, further including an indicia plate mounted to said cowling, whereby upon said indicia plate are alignment markings to indicate the setting of said speed adjustment screw and three positions of said key in said cam lock cylinder.

9. An adjustable speed control system for a motor vehicle comprising:

a) a first flexible cable having a first end connected to a throttle lever on a carburetor in an internal combustion engine of the motor vehicle:

b) a second flexible cable having a first end connected to a throttle control handle on the motor vehicle;

c) means mounted within the motor vehicle for coupling a second end of said first flexible cable to a second end of said second flexible cable, wherein said coupling means includes a casing and a cable connector carried within said casing, to retain together the second ends of said first flexible cable and said second flexible cable and a speed control assembly extending into said casing to engage with said cable connector and limit movement of said cable connector within said casing;

d) a housing;

e) a speed adjustment assembly carried within said housing;

f) a third flexible cable having a first end connected to said speed control assembly within said casing and a second end connected to said speed adjustment assembly;

g) a speed engagement assembly carried within said housing; and h) a fourth flexible cable having a first end connected to said speed control assembly extending from said casing and a second end connected to said speed engagement assembly.

10. An adjustable speed control system for a motor vehicle as recited in claim 9, wherein said speed control assembly includes:

a) an enclosure having a passageway which extends perpendicular into said casing;

b) an engagement shaft mounted in a sliding manner within said passageway of said enclosure and connected at a top end to the first end of said fourth flexible cable;

c) an engagement cap affixed to a bottom end of said engagement shaft;

d) an engagement lever pivotally affixed to said cap; and e) a compression spring on said engagement shaft to bias said engagement shaft, so that said engagement lever will normally extend perpendicular into the path of said cable connector.

11. An adjustable speed control system for a motor vehicle as recited in claim 10, wherein said speed adjustment assembly includes:

a) a speed adjustment screw having a threaded shaft and an enlarged head carried within said housing, so that said enlarged head extends through said housing;

b) a locking nut affixed onto an inner end of said threaded shaft of said speed adjustment screw; and c) an adjustable cable retainer on said threaded shaft of said speed adjustment screw which connects to the second end of said third flexible cable; and d) an extension spring connected longitudinally between one side of said enclosure of said speed control assembly within said casing and attached to said casing with the first end of said third flexible cable connected longitudinally to an opposite side of said enclosure of said speed control assembly within said casing, so that said engagement lever can be adjusted longitudinally with respect to said cable connector.

12. An adjustable speed control system for a motor vehicle as recited in claim 11, wherein said speed engagement assembly includes:

a) an engagement cam rotatably carried within said housing, to contact said speed adjustment screw;

b) a fixed cable retainer on said engagement cam which connects to the second end of said fourth flexible cable;

c) an engagement cam driver connected to said engagement cam;

d) a cam lock cylinder connected to said engagement cam driver; and e) a key insertable into said cam lock cylinder to operate said cam lock cylinder.

13. An adjustable speed control system for a motor vehicle as recited in claim 12, wherein said enlarged head of said speed adjustment screw includes alignment markings to indicate the setting of said speed adjustment screw.

14. An adjustable speed control system for a motor vehicle as recited in claim 13, wherein said cam lock cylinder includes three positions operable by said key, which are off, adjustment and on, whereby when said key is turned to the off position, said engagement lever will move away from the path of said cable connector, when said key is turned to the adjust position said speed adjustment screw can be turned to adjust said engagement lever with respect to said cable connector, and when said key is turned to the on position and then removed from said cam lock cylinder, said engagement lever will be maintained in place with respect to said cable connector.

15. An adjustable speed control system for a motor vehicle as recited in claim 14, further including a cowling to secure said housing with said speed adjustment assembly and said speed engagement assembly to the motor vehicle.

16. An adjustable speed control system for a motor vehicle as recited in claim 15, further including an indicia plate mounted to said cowling, whereby upon said indicia plate are alignment markings to indicate the setting of said speed adjustment screw and three positions of said key in said cam lock cylinder.

* * * * *